US011459819B2

(12) United States Patent
Liu

(10) Patent No.: US 11,459,819 B2
(45) Date of Patent: Oct. 4, 2022

(54) VENETIAN BLIND

(71) Applicant: ALWA INDUSTRIAL INC., Taichung (TW)

(72) Inventor: Tai-Ping Liu, Taichung (TW)

(73) Assignee: ALWA INDUSTRIAL INC., Taichung (TW)

( * ) Notice: Subject to any disclaimer, the term of this patent is extended or adjusted under 35 U.S.C. 154(b) by 161 days.

(21) Appl. No.: 16/522,657

(22) Filed: Jul. 26, 2019

(65) Prior Publication Data

US 2021/0025227 A1 Jan. 28, 2021

(51) Int. Cl.
*E06B 9/322* (2006.01)
*B65H 75/48* (2006.01)

(52) U.S. Cl.
CPC ..... *E06B 9/322* (2013.01); *B65H 75/486* (2013.01); *E06B 2009/3222* (2013.01)

(58) Field of Classification Search
CPC .... E06B 9/32; E06B 9/322; E06B 2009/3222; B65H 75/486
See application file for complete search history.

(56) References Cited

U.S. PATENT DOCUMENTS 7,128,122 B2 * 10/2006 Lin ..... E06B 9/324 160/168.1 P
2004/0007333 A1 * 1/2004 Militello ..... E06B 9/322 160/84.04
2005/0087394 A1 * 4/2005 Toti ..... E06B 9/322 185/37
2008/0236764 A1 * 10/2008 Cheng ..... E06B 9/322 160/84.02
2011/0290429 A1 * 12/2011 Cheng ..... E06B 9/322 160/84.02
2012/0061502 A1 * 3/2012 Chen ..... E06B 9/322 242/378
2017/0107075 A1 * 4/2017 Hung ..... E06B 9/322
2019/0162016 A1 * 5/2019 Chen ..... E06B 9/322
2019/0292845 A1 * 9/2019 Chen ..... E06B 9/322
2020/0180902 A1 * 6/2020 Zheng ..... B65H 75/486
2020/0370368 A1 * 11/2020 Huang ..... E06B 9/324

FOREIGN PATENT DOCUMENTS

CN 101046142 A * 10/2007 ..... E06B 9/322

* cited by examiner

*Primary Examiner* — Johnnie A. Shablack
*Assistant Examiner* — Jeremy C Ramsey
(74) *Attorney, Agent, or Firm* — Bruce Stone LLP; Joseph A. Bruce

(57) ABSTRACT

A Venetian blind includes two string reels, two spring reels, a leaf spring and a wheel set. The string reels are engaged with each other. The spring reels engaged with each other. The leaf spring includes two sections respectively wound on the spring reels so that one of the sections of the leaf spring gets longer and the remaining one of the sections of the leaf spring gets shorter when the spring reels are rotated. The wheel set connects one of the string reels to one of the spring reels. None of the spring reels is engaged with any of the string reels without the wheel set.

7 Claims, 14 Drawing Sheets

VENETIAN BLIND

BACKGROUND OF INVENTION

1. Field of Invention

The present invention relates to a Venetian blind and, more particularly, to a rope-free Venetian blind.

2. Related Prior Art

A typical Venetian blind includes slats, connective strings for interconnecting the slats and a maneuver rope operable to lift or lower the slats. The slats are moved toward one another when they are lifted. The slats are moved from one another when they are lowered.

A rope-free Venetian blind includes slats does not include such a maneuver rope. The rope-free Venetian blind includes connective strings for interconnecting the slats, two operative strings connected to the lowest one of the slats, and a transmission connected to the operative strings. A user lifts and moves the slats toward one another or lowers and moves the slats from one another with a bare hand.

The transmission that includes a single train of interconnected gears. Two of the gears in the middle alternatively drive a leaf spring. Two of the gears on the sides wind or unwind two ropes that connect the slats to one another, thereby lifting and moving the slats toward one another or lowering and moving the slats from one another.

The gear ratio of the gears is fixed. Hence, a model of transmissions is good for only Venetian blinds with a same value of weight. Venetian blinds with different values of weight need different models of transmissions. Therefore, a manufacturer has to keep many models of transmissions. Such a considerable inventory brings a heavy financial burden on the manufacturer. Moreover, it takes quite some time to pick a proper model of transmissions for Venetian blinds with a certain value of weight.

The present invention is therefore intended to obviate or at least alleviate the problems encountered in prior art.

SUMMARY OF INVENTION

It is the primary objective of the present invention to provide an inexpensive Venetian that can easily be made.

To achieve the foregoing objective, the Venetian blind includes two string reels, two spring reels, a leaf spring and a wheel set. The string reels are engaged with each other. The spring reels engaged with each other. The leaf spring includes two sections respectively wound on the spring reels so that one of the sections of the leaf spring gets longer and the remaining one of the sections of the leaf spring gets shorter when the spring reels are rotated. The wheel set connects one of the string reels to one of the spring reels. None of the spring reels is engaged with any of the string reels without the wheel set.

Other objectives, advantages and features of the present invention will be apparent from the leading description referring to the attached drawings.

BRIEF DESCRIPTION OF DRAWINGS

The present invention will be described via detailed illustration of six embodiments referring to the drawings wherein.

DETAILED DESCRIPTION OF EMBODIMENTS

Figure 1:
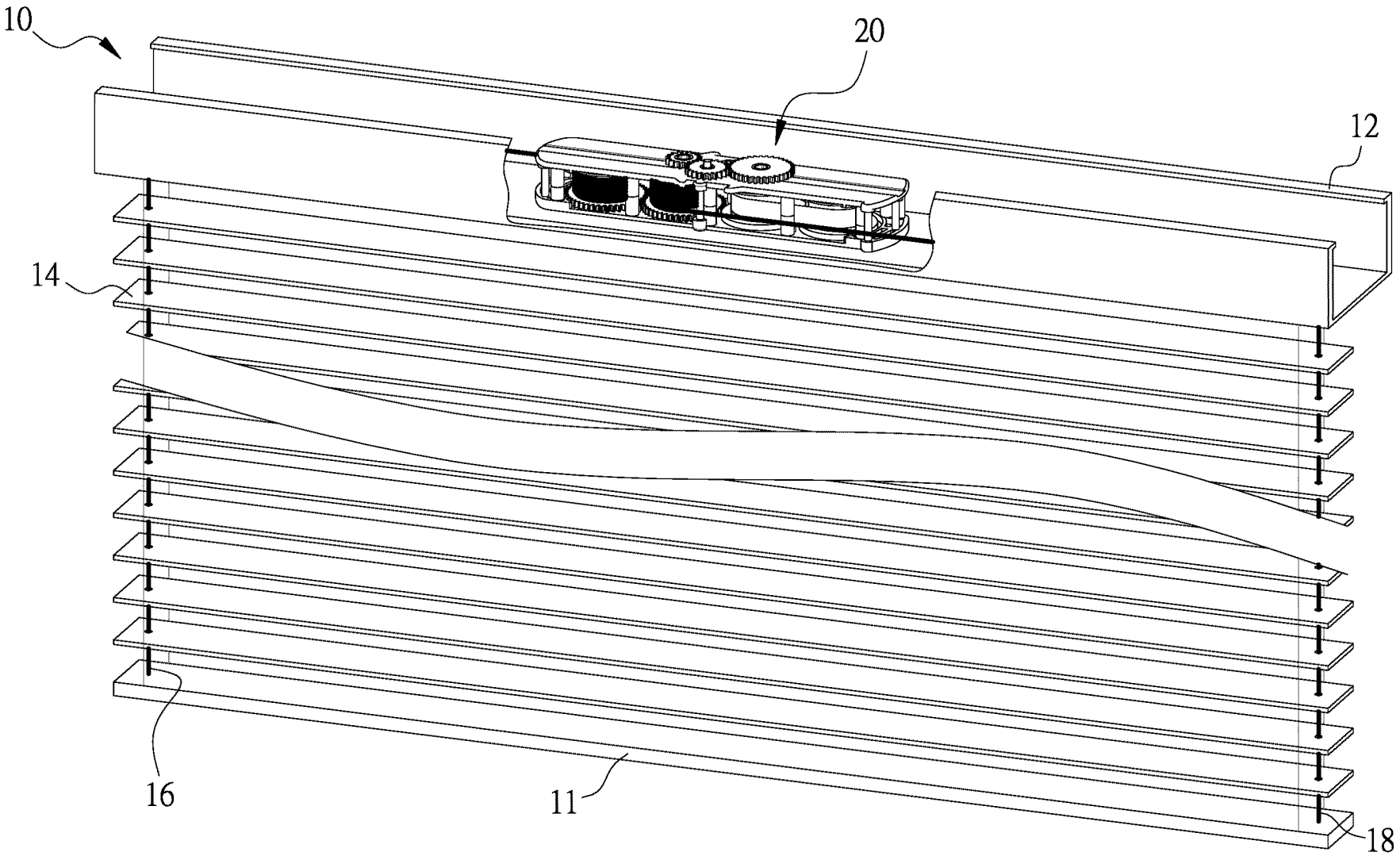
FIG. 1 is a perspective view of a Venetian blind according to the first embodiment of the present invention.
Figure 2:
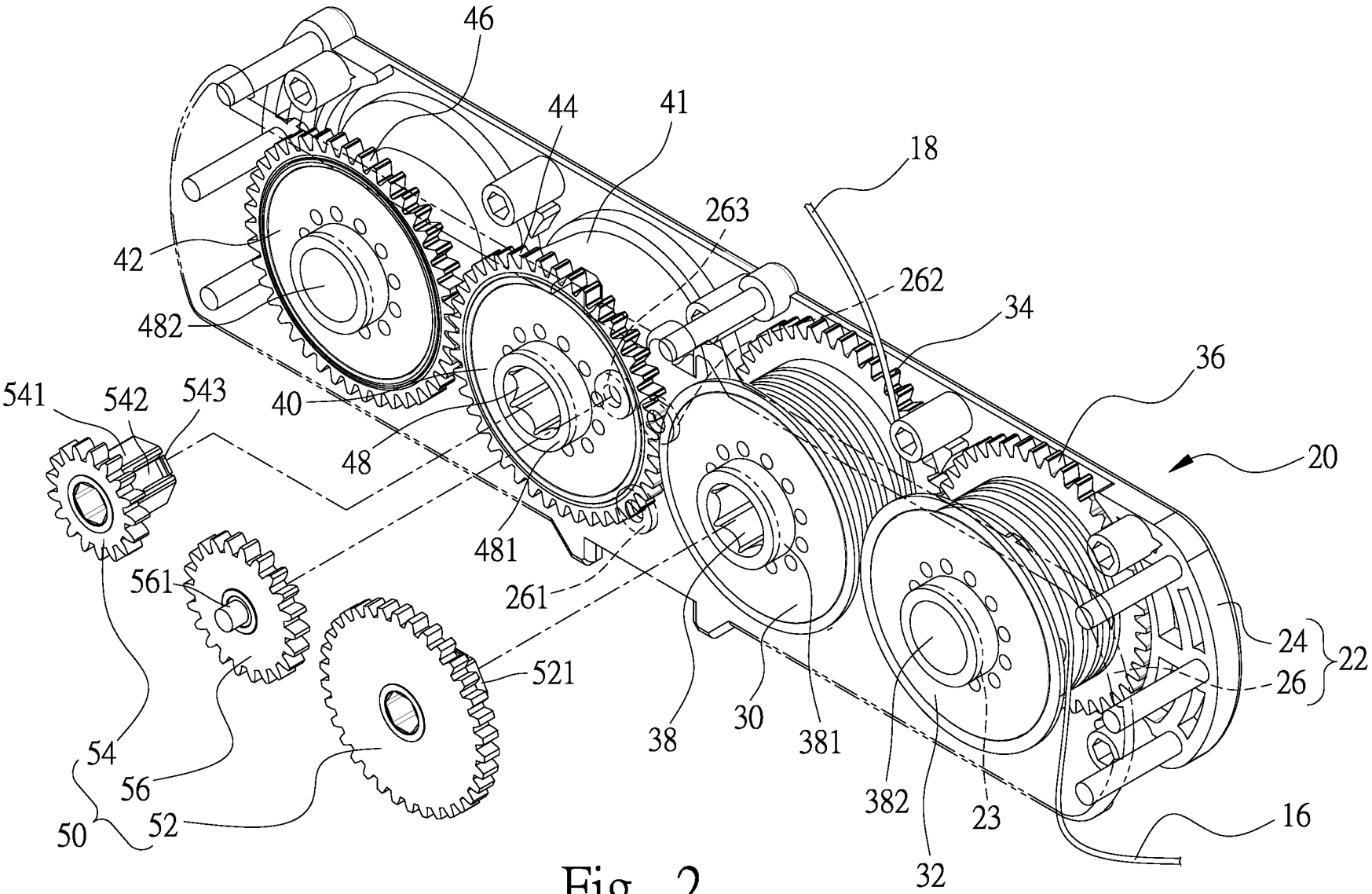
FIG. 2 is an exploded view of a transmission of the Venetian blind shown in FIG. 1.
Figure 3:
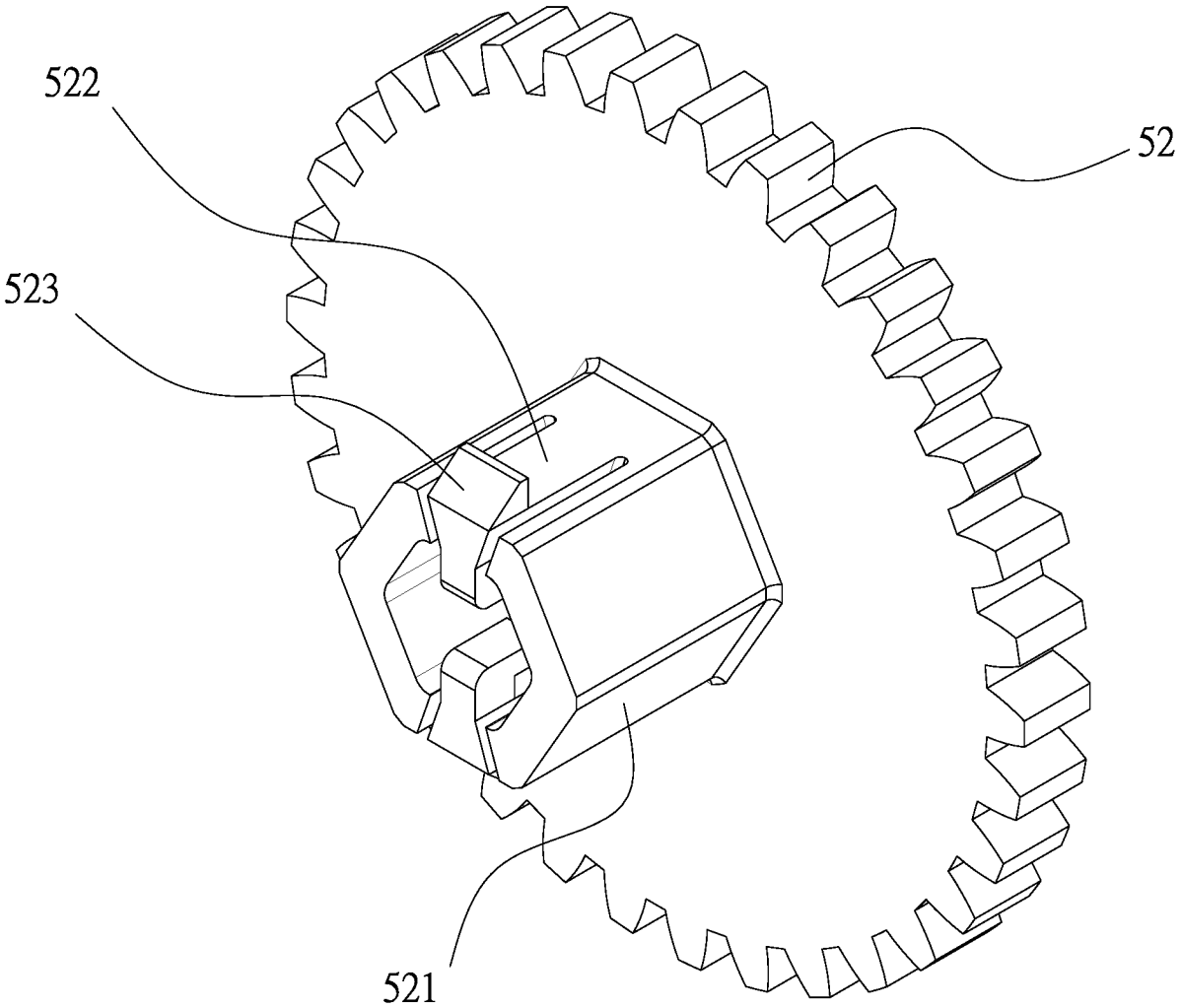
FIG. 3 is a perspective view of a gear of the transmission depicted in FIG. 2.
Figure 4:
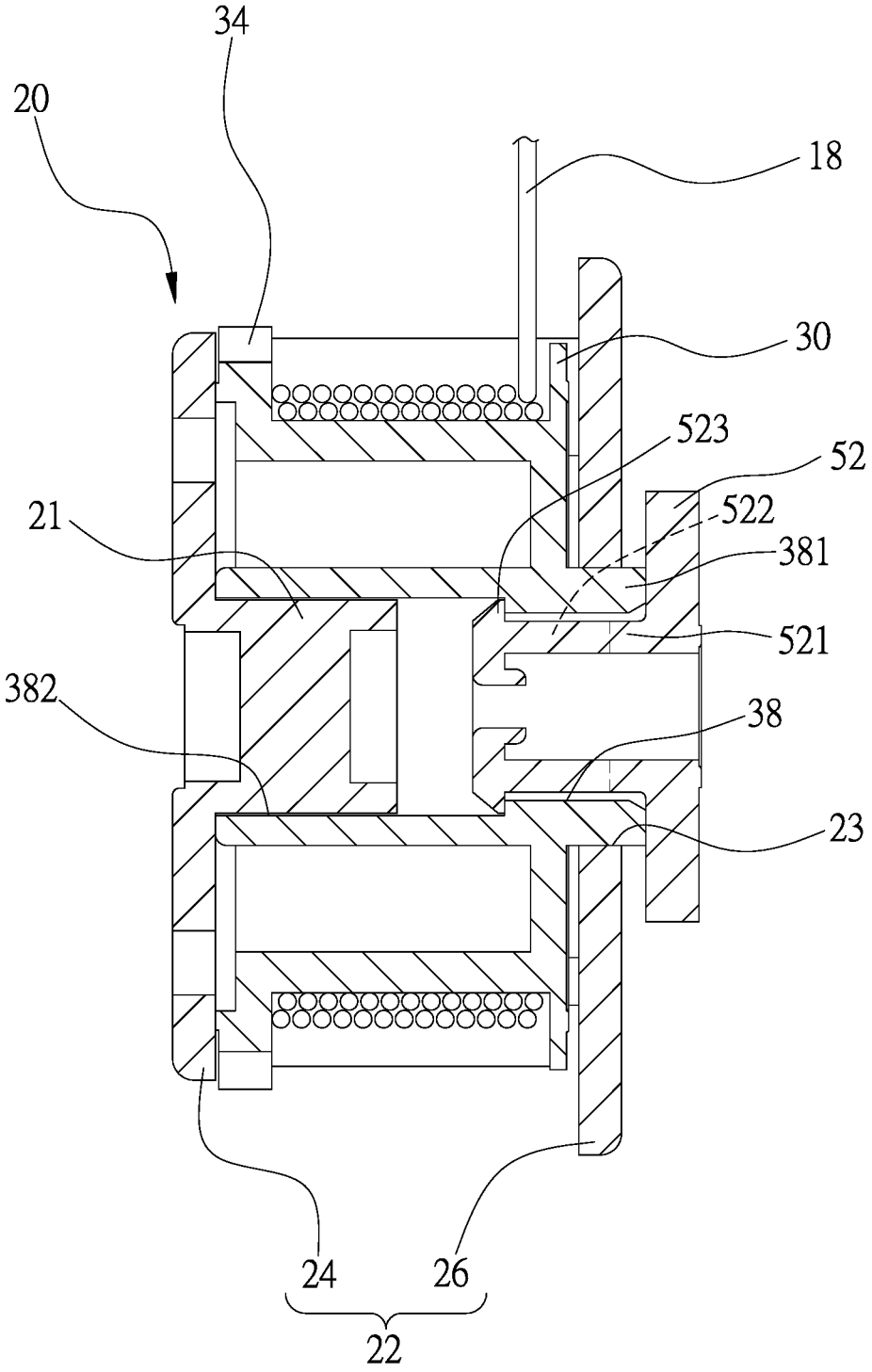
FIG. 4 is a cross-sectional view of the transmission shown in FIG. 2

Referring to FIG. 1, a Venetian blind 10 includes a weight 11, a trough 12, slats 14, two operative strings 16 and 18 and a transmission 20. The transmission 20 is inserted in the trough 12. The weight 11 is shaped like the slats 14, but thicker and heavier. The slats 14 are located between the weight 11 and the trough 12. The weight 11 and the slats 14 are connected to the trough 12 by two connective strings (not numbered) that are operable to tilt the slats 14. Each of the operative strings 16 and 18 includes an end tied to the weight 11 and another end connected to the transmission 20. The operative strings 16 and 18 extend throughout the slats 14.

In use, the trough 12 is attached to a wall above a window. The weight 11 is movable between a lower limit and an upper limit. The slats 14 are movable toward one another when the weight 11 is moved toward the upper limit. The slats 14 do not blind the window when the weight 11 is located at the upper limit. The slats 14 are movable from one another when the weight 11 is moved toward the lower limit. The slats 14 blind the window when the weight 11 is located at the lower limit.

Referring to FIGS. 2 through 5, the transmission 20 includes a frame 22, two string reels 30 and 32, two spring reels 40 and 42, and a wheel set 50 according to a first embodiment of the present invention.

Each of the string reels 30 and 32 is formed with an axle 381. Each of the axles 381 includes an axial bore 382. Each of the spring reels 40 and 42 is formed with an axle 481. Each of the axles 481 includes an axial bore 482.

The frame 22 includes two plates 24 and 26 that extend parallel to each other and are interconnected by rods (not numbered). The plate 24 includes shafts 21 extending from a front face. The shafts 21 are arranged along a phantom line at equal distances.

The plate 26 is made with axle-receiving apertures 23 corresponding to the shafts 21. The plate 26 further includes apertures 261, 262 and 263.

Each of the shafts 21 is inserted in a corresponding one of the axial bores 382 and 482. Each of the axle-receiving apertures 23 receives a corresponding one of the axles 381 and 481. Thus, the string reels 30 and 32 and the spring reels 40 and 42 are located between and supported on the plates 24 and 26. The string reels 30 and 32 are located in the vicinity of an end of the frame 22 while the spring reels 40 and 42 are located in the vicinity of another end of the frame 22.

The string reels 30 and 32 are substantially identical to each other regarding the structure. The operative string 16 is wound on the string reel 32 while the operative string 18 is wound on the string reel 30. The string reel 30 is formed with a gear 34 while the string reel 32 is formed with a gear 36. In the vicinity of the plate 24, the gears 34 and 36 are engaged with each other so that the string reels 30 and 32 are rotatable together, in opposite senses of direction.

The string reel 30 is different from the string reel 32 in one aspect, i.e., the string reel 30 includes a polygonal bore 38 in communication with the axial bore 382 of the same, but the string reel 32 does not. The polygonal bore 38 is preferably a hexagonal one.

The spring reels 40 and 42 are substantially identical to each other regarding the structure. Moreover, the spring reels 40 and 42 are identical to the string reels 30 and 32 regarding the structure. The spring reel 40 includes a gear 44 while the spring reel 42 includes a gear 46. In the vicinity of the plate 26, the gears 44 and 46 are engaged with each other so that the spring reels 40 and 42 are rotatable together, in opposite senses of direction.

The spring reel 40 is different from the spring reel 42 in one aspect, i.e., the spring reel 40 includes a polygonal bore 48 in communication with the axial bore 482, but the spring reel 42 does not. The polygonal bore 48 is preferably a hexagonal one.

A leaf spring 41 is wound on the spring reels 40 and 42 to provide a torque used to rotate the string reels 30 and 32. An end of the leaf spring 41 is connected to the spring reel 40 while another end of the leaf spring 41 is connected to the spring reel 42. A first section of the leaf spring 41 is wound on the spring reel 40 while a second section of the leaf spring 41 is wound on the spring reel 42. The first section of the leaf spring 41 gets longer when the second section of the leaf spring 41 gets shorter. The first section of the leaf spring 41 gets shorter when the second section of the leaf spring 41 gets longer.

As mentioned above, the gears 44 and 46 are located in the vicinity of the plate 26 while the gears 34 and 36 are located in the vicinity of the plate 24. Hence, the spring reels 40 and 42 cannot be engaged with the string reels 30 and 32 without the wheel set 50.

Preferably, the wheel set 50 includes a leading gear 54, a following gear 52 and an intermediate gear 56. Each of the gears 52, 54 and 56 is formed with teeth. A diameter of the intermediate gear 54 is smaller than a diameter of the intermediate gear 56. The diameter of the intermediate gear 56 is smaller than a diameter of the following gear 52. Thus, the wheel set 50 is a reducer.

The following gear 52 includes a polygonal insert 521, two elastic bars 522 and two barbs 523. The polygonal insert 521 is preferably a hexagonal one. The polygonal insert 521 is inserted in the polygonal bore 38 to render the following gear 52 and the string reel 30 rotatable with each other. The elastic bars 522 are located on two opposite sides of the polygonal insert 521. Each of the elastic bars 522 is made by cutting two slits in the polygonal insert 521. Each of the barbs 523 is formed at an end of a corresponding one of the elastic bars 522.

The elastic bars 522 allow the barbs 523 to move toward each other during insertion of the polygonal insert 521 into the polygonal bore 38. The barbs 523 expand from each other to engage with a shoulder formed between the polygonal bore 38 and the axial bore 382 when the polygonal insert 521 is inserted in the polygonal bore 38. Thus, the following gear 52 is locked to the string reel 30.

The leading gear 54 includes a polygonal insert 541, two elastic bars 542 and two barbs 543. The barbs 543 are engaged with a shoulder formed between the polygonal bore 48 and the axial bore 482 when polygonal insert 541 is inserted in the polygonal bore 48. Thus, the leading gear 54 is locked to the spring reel 40. The leading gear 54 is rotatable together with the spring reel 40.

The intermediate gear 56 includes an axle 561. The intermediate gear 56 is engaged with the following gear 52 and the leading gear 54 so that the following gear 52 is rotatable in a same sense of direction with the leading gear 54.

Figure 5:
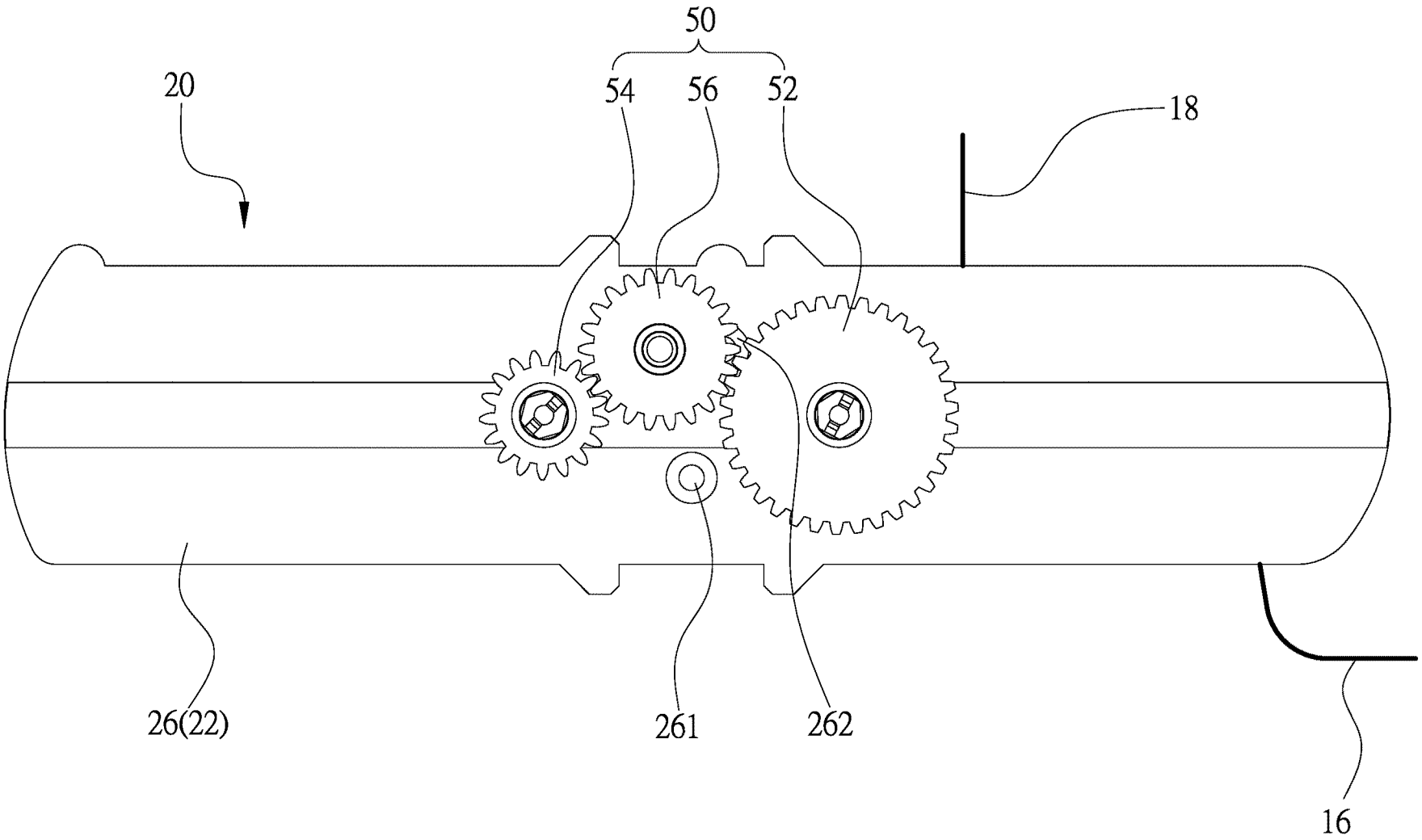
FIGS. 5 through 7 are front views of the transmission providing different gear ratios.
Figure 6:
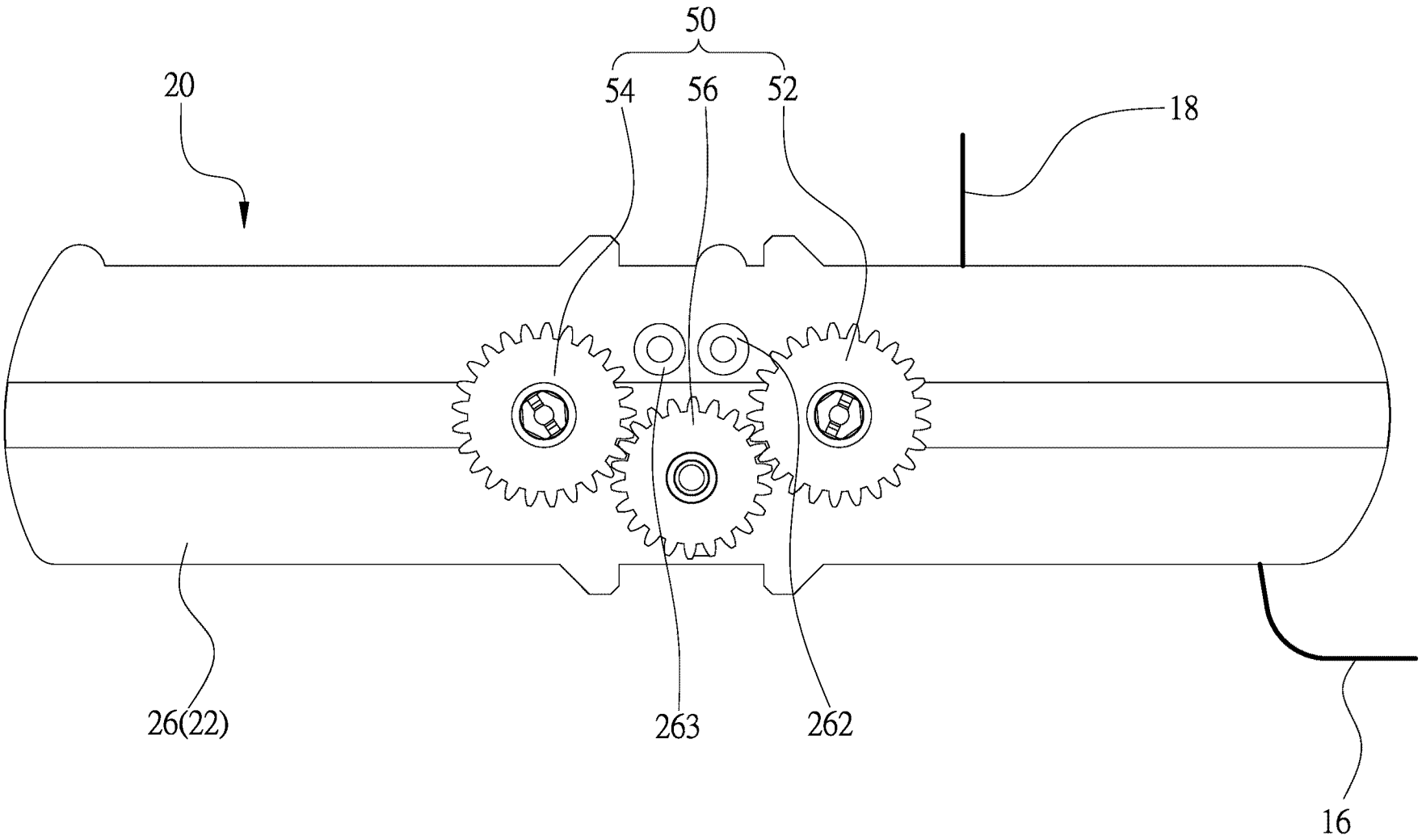
Figure 7:
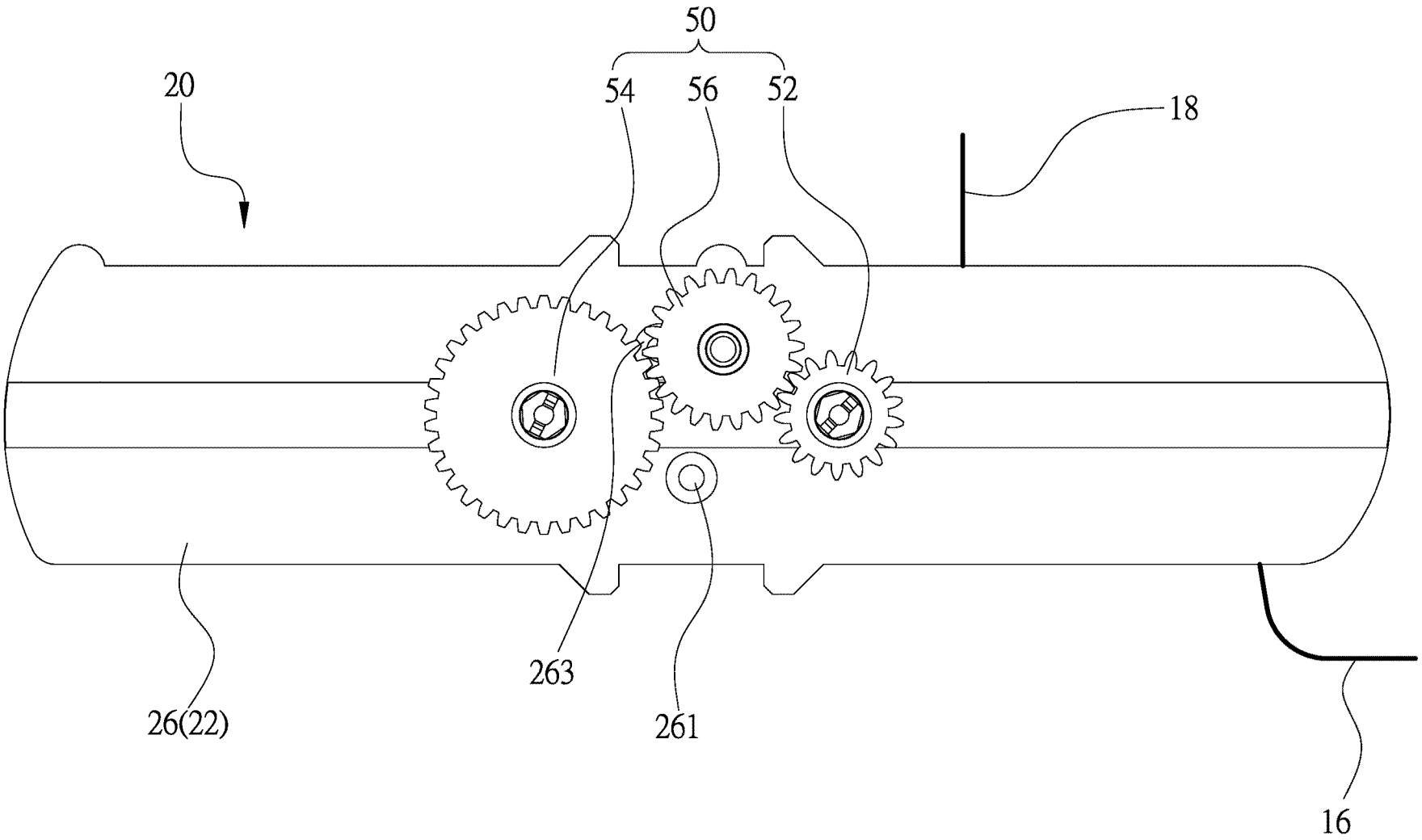

The wheel set 50 includes three combinations of the gears 52, 54 and 56 referring to FIGS. 5 through 7, respectively. Each of the combinations of the gears 52, 54 and 56 provides a gear ratio suitable for a certain value of weight of a rope-free Venetian blind.

Referring to FIG. 5, in the first combination, the diameter of the intermediate gear 56 is larger than the diameter of the leading gear 54 but smaller than the diameter of the following gear 52. Hence, the number of the teeth of the intermediate gear 56 is larger than the number of the teeth of the leading gear 54 but smaller than the number of the teeth of the following gear 52. That is, the first combination of the gears 52, 54 and 56 provides a small gear ratio suitable for a large value of weight of a rope-free Venetian blind. To allow the intermediate gear 56 to engage with the following gear 52 and the leading gear 54, the axle 561 is inserted in the aperture 263.

Referring to FIG. 6, in the second combination, the diameter of the leading gear 54 is identical to the diameter of the following gear 52. Hence, the number of the teeth of the leading gear 54 is equal to the number of the teeth of the following gear 52. That is, the second combination of the gears 52, 54 and 56 provides a gear ratio of 1:1 suitable for a medium value of weight of a rope-free Venetian blind. To allow the intermediate gear 56 to engage with the following gear 52 and the leading gear 54, the axle 561 is inserted in the aperture 261.

Referring to FIG. 7, in the third combination, the diameter of the intermediate gear 56 is smaller than the diameter of the leading gear 54 but larger than the diameter of the following gear 52. Hence, the number of the teeth of the intermediate gear 56 is smaller than the number of the teeth of the leading gear 54 but larger than the number of the teeth of the following gear 52. That is, the first combination of the gears 52, 54 and 56 provides a large gear ratio suitable for a small value of weight of a rope-free Venetian blind. To allow the intermediate gear 56 to engage with the following gear 52 and the leading gear 54, the axle 561 is inserted in the aperture 262.

The transmission 20 exhibits two advantageous features. Firstly, the string reel 30 is engaged with the wheel set 50 and so is the spring reel 40. None of the string reels 30 and 32 is engaged with any of the spring reels 40 and 42. Hence, the gear ratio (the ratio of the diameter of the gear 54 over the diameter of the gear 52) of the transmission 20 can be changed by replacing a wheel set 50 with another wheel set 50, without having to replacing any of the reels 30, 32, 40, 42 with another reel. Secondly, the wheel set 50 is located out of the frame 22. Thus, the replacement of the wheel set 50 can easily be executed.

Figure 8:
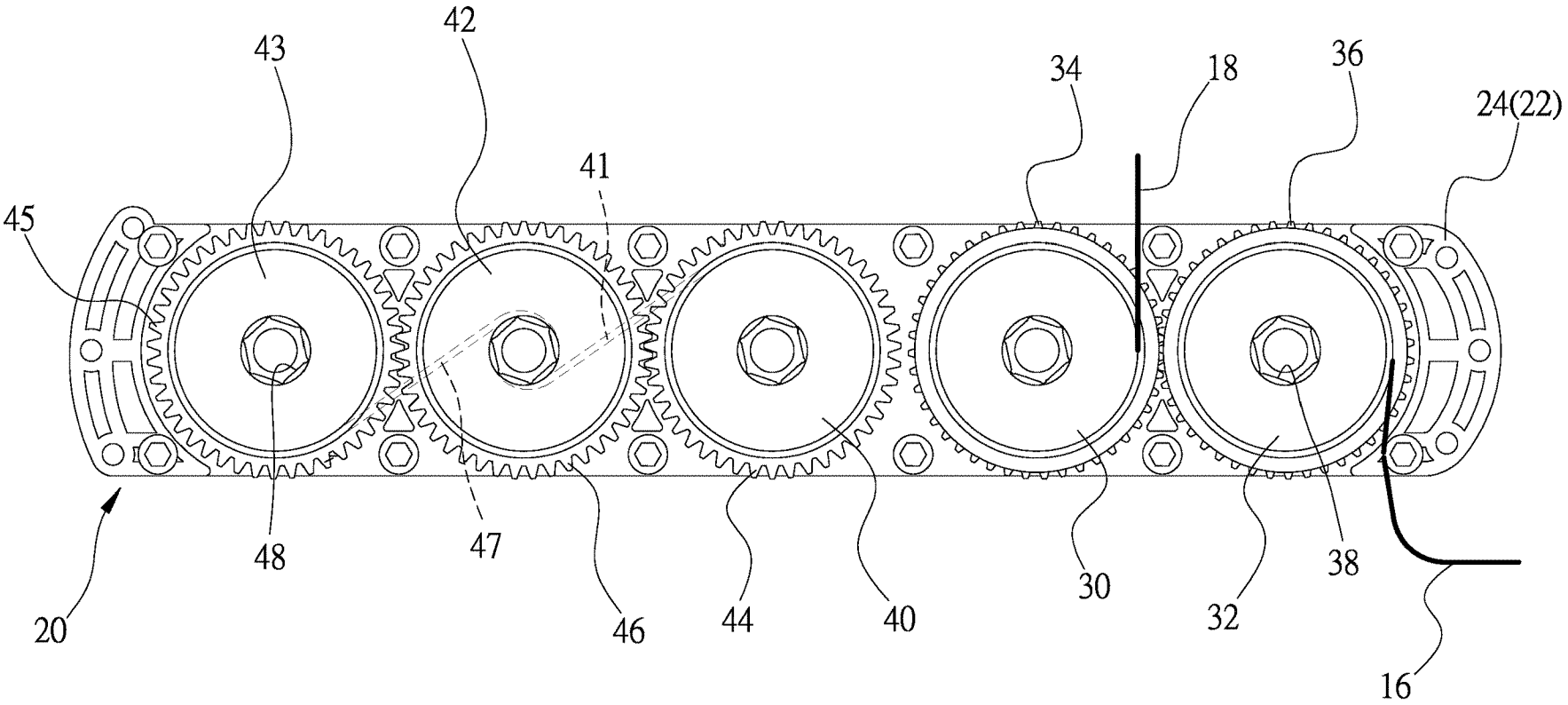
FIG. 8 is a front view of a transmission according to the second embodiment of the present invention.

Referring to FIG. 8, there is shown a transmission 20 according to a second embodiment of the present invention.

The second embodiment is identical to the first embodiment except for including a spring reel 43 and a leaf spring 47 in addition.

The spring reel 43 is formed with a gear 45 engaged with the gear 46. Thus, the spring reels 43 and 42 are rotatable in opposite senses of direction, and the spring reels 43 and 40 are rotatable in a same sense of direction.

An end of the leaf spring 47 is connected to the spring reel 42. Another end of the leaf spring 47 is connected to the spring reel 43.

The leaf springs 41 and 47 are wound onto the spring reel 42 and overlapped when the spring reel 42 is rotated in a clockwise manner. The leaf spring 41 is unwound from the spring reel 40 as the leaf spring 41 is wound onto the spring reel 42. The leaf spring 47 is unwound from the spring reel 43 when the leaf spring 47 is wound onto the spring reel 42.

The leaf springs 41 and 47 are unwound from the spring reel 42 when the spring reel 42 is rotated in a counterclockwise manner. The leaf spring 41 is wound onto the spring reel 40 when the leaf spring 41 is unwound from the spring reel 42. The leaf spring 47 is wound onto the spring reel 43 when the leaf spring 47 is unwound from the spring reel 42.

In addition, each of the string reels 30 and 32 includes a polygonal bore 38 and each of the spring reels 40 and 42, 43 includes a polygonal bore 48. Thus, location of the string reels 30 and 32 and the spring reels 40, 42 and 43 in correct positions is ensured.

Figure 9:
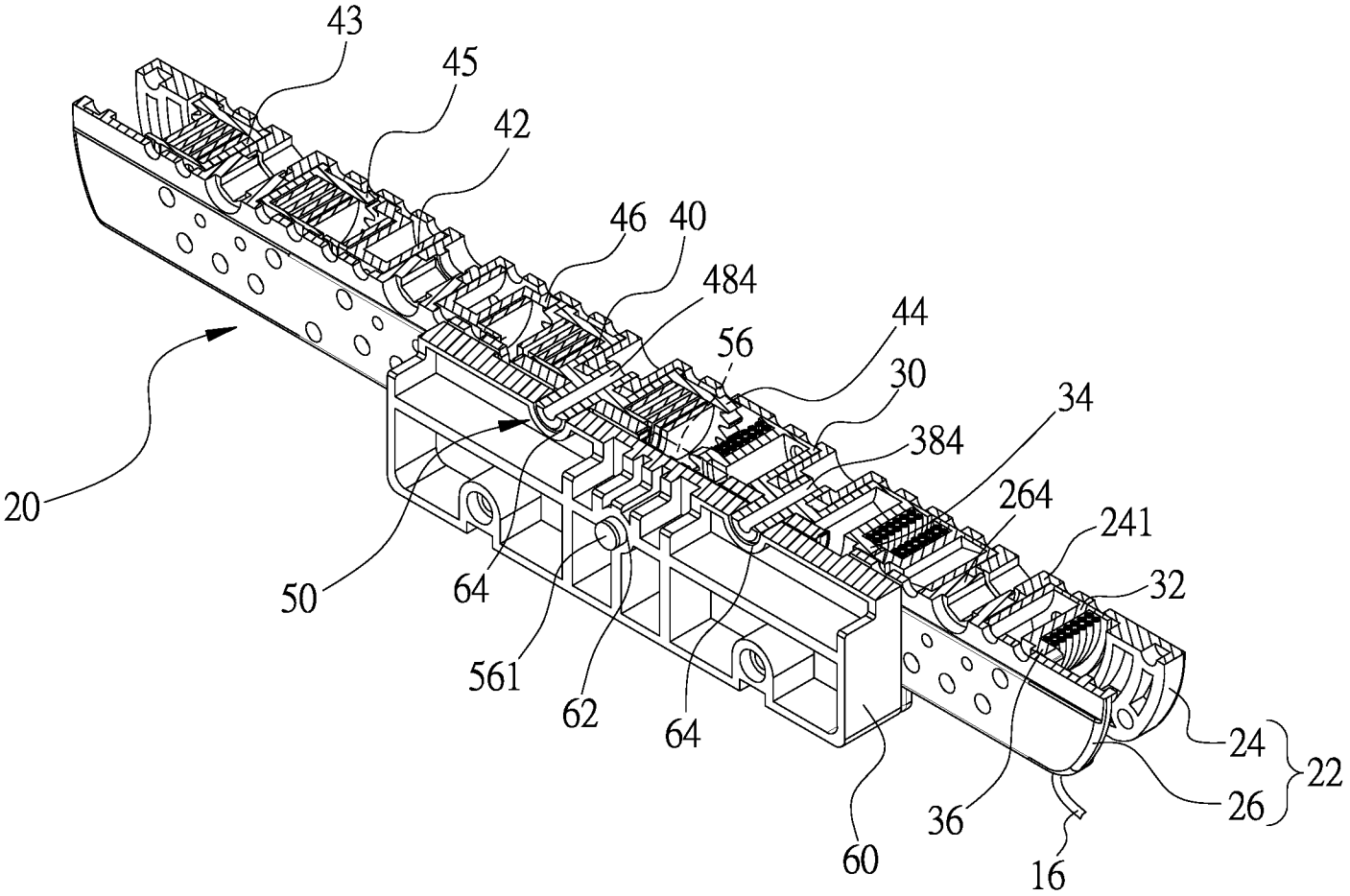
FIG. 9 is a cut-away view of a transmission according to the third embodiment of the present invention.
Figure 10:
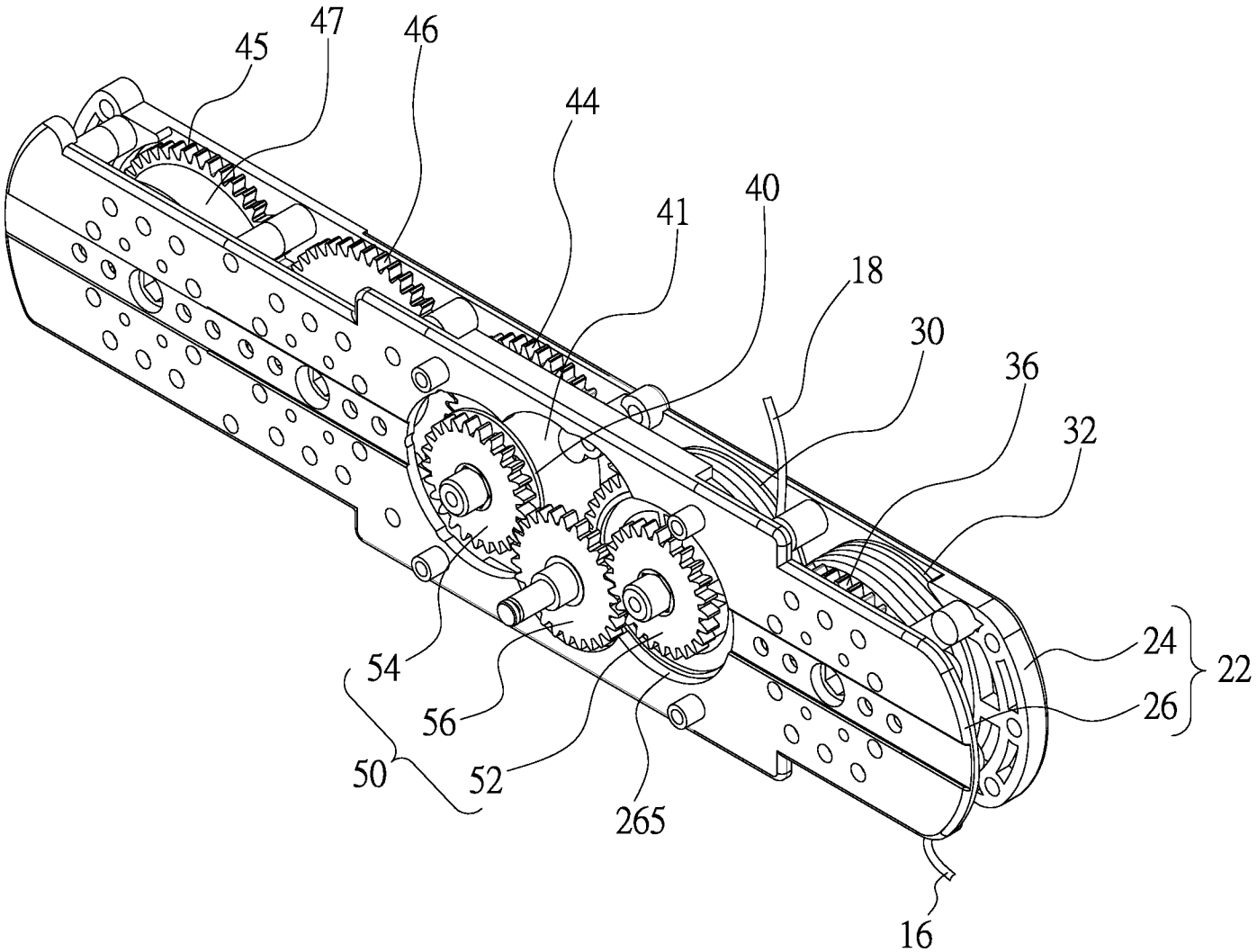
FIG. 10 is a perspective view of the transmission shown in FIG. 9.
Figure 11:
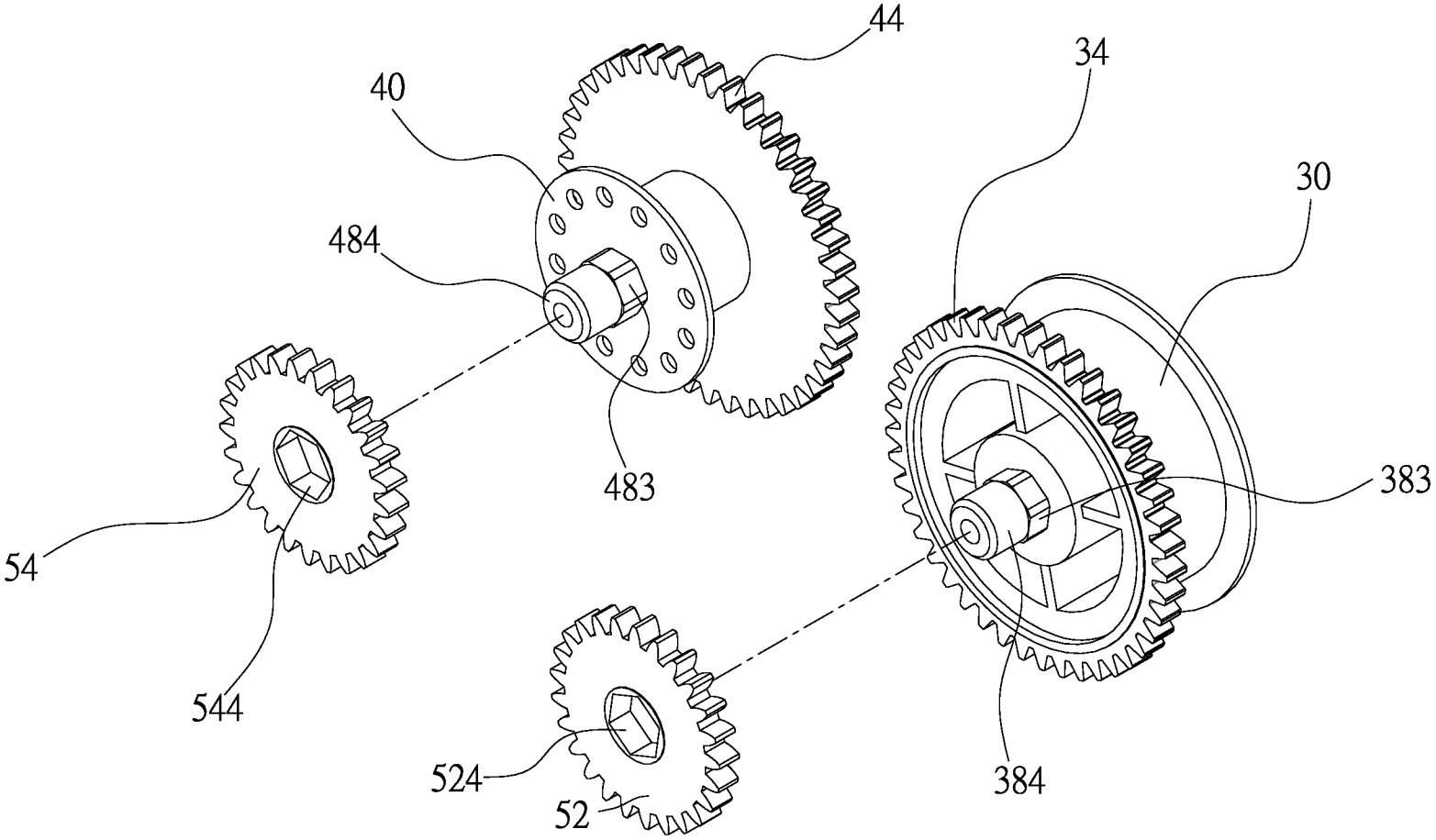
FIG. 11 is a partial and exploded view of the transmission shown in FIG. 9.

Referring to FIGS. 9 to 11, there is shown a transmission 20 according to a third embodiment of the present invention. The third embodiment is identical to the second embodiment except for several features.

Firstly, an additional cover 60 is connected to a front face of the plate 26 to cover an opening 265 made in the plate 26.

Secondly, three hollow shafts 241 extend from the front face of the plate 24. Three hollow shafts 264 extend from the front face of the plate 26. Each of the shafts 241 and a corresponding one of the shafts 264 form a combination of shafts. A combination of shafts 241 and 264 is inserted in the string reel 32, which is located in the vicinity of an end of opening 265. Thus, the string reel 32 is rotatable relative to the frame 22. Another combination of shafts 241 and 264 is inserted in the spring reel 42, which is located in the vicinity of another end of opening 265. The other combination of shafts 241 and 264 is inserted in the spring reel 43. Thus, the spring reels 42 and 43 are rotatable relative to the frame 22.

The gears 34 and 36 are located in the vicinity of the plate 26, and the gears 44, 45 and 46 are located in the vicinity of the plate 24. The string reels 30 and 32 cannot be engaged with the spring reels 40, 42 and 43 without the wheel set 50. The wheel set 50 connects the string reel 30 to the spring reel 40.

Thirdly, the string reel 30 includes a rod 384 formed with an end inserted in one of the shafts 241 and another end inserted in an aperture 64 made in the cover 60 via a polygonal aperture 524 made in the following gear 52. Thus, the string reel 30 is rotatable relative to the frame 22. The polygonal aperture 524 of the following gear 52 receives a polygonal section 383 of the rod 384. Thus, the rod 384 rotates the following gear 52 in the opening 265 of the plate 26.

Fourthly, the spring reel 40 includes a rod 484 formed with an end inserted in another one of the shafts 241 and another end inserted in another axle-receiving aperture 64 made in the cover 60, thereby rendering the spring reels 40 rotatable relative to the frame 22. The rod 484 is formed with a polygonal section 483 inserted in a polygonal aperture 544. Thus, the leading gear 54 is rotatable in the opening 265 of the plate 26.

The axle 561 of the intermediate gear 56 is inserted in one of several apertures 62 made in the cover 60 to keep the intermediate gear 56 engaged with the following gear 52 and the leading gear 54. Thus, the wheel set 50 transfers a torque to the string reel 30 from the spring reels 40.

Figure 12:
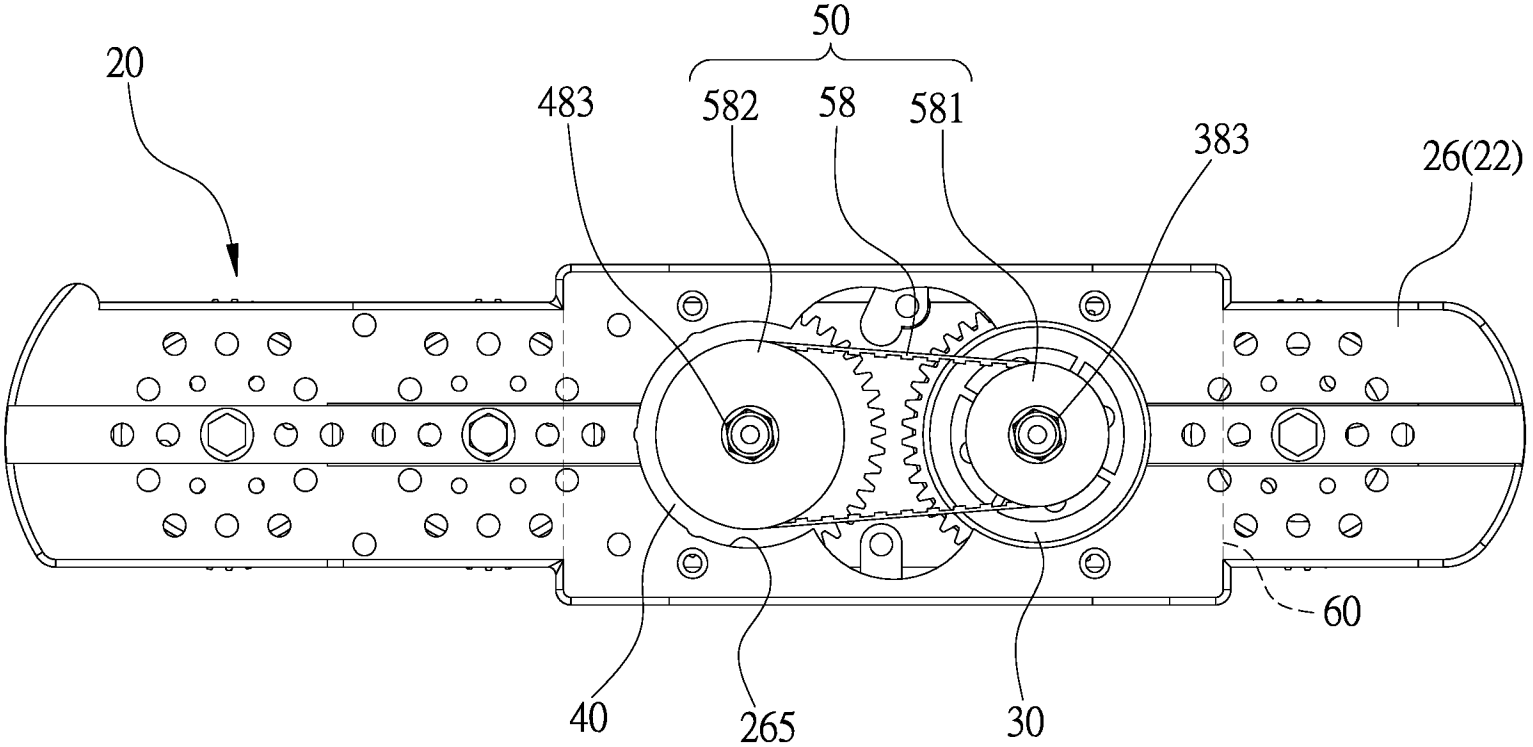
FIG. 12 is a front view of a transmission according to the fourth embodiment of the present invention.

Referring to FIG. 12, there is shown a transmission 20 according to a fourth embodiment of the present invention. The fourth embodiment is identical to the third embodiment except for that the wheel set 50 includes a belt 58 wound on two pulleys 581 and 582 instead of the gears 52, 54 and 56. Various combinations of pulleys 581 and 582 can be used, i.e., the ratio of the diameter of the pulley 582 over the diameter of the pulley 581 can be changed. The diameter of the pulley 582 is preferably smaller than the diameter of the pulley 581. The belt 58 includes teeth (not numbered) on an internal face. Each of the pulleys 581 and 582 includes teeth (not numbered) engaged with the teeth of the belt 58. The pulley 581 includes a polygonal aperture (not numbered) that receives the polygonal section 383 of the string reel 30 so that the pulley 581 is rotatable with the string reel 30. The pulley 582 includes a polygonal aperture (not numbered) that receives the polygonal section 483 of the spring reel 40 so that the pulley 582 is rotatable with the spring reel 40. Thus, the pulley 582 rotate the pulley 581 via the belt 58, i.e., the wheel set 50 transfers a torque to the string reel 30 from the spring reel 40.

Figure 13:
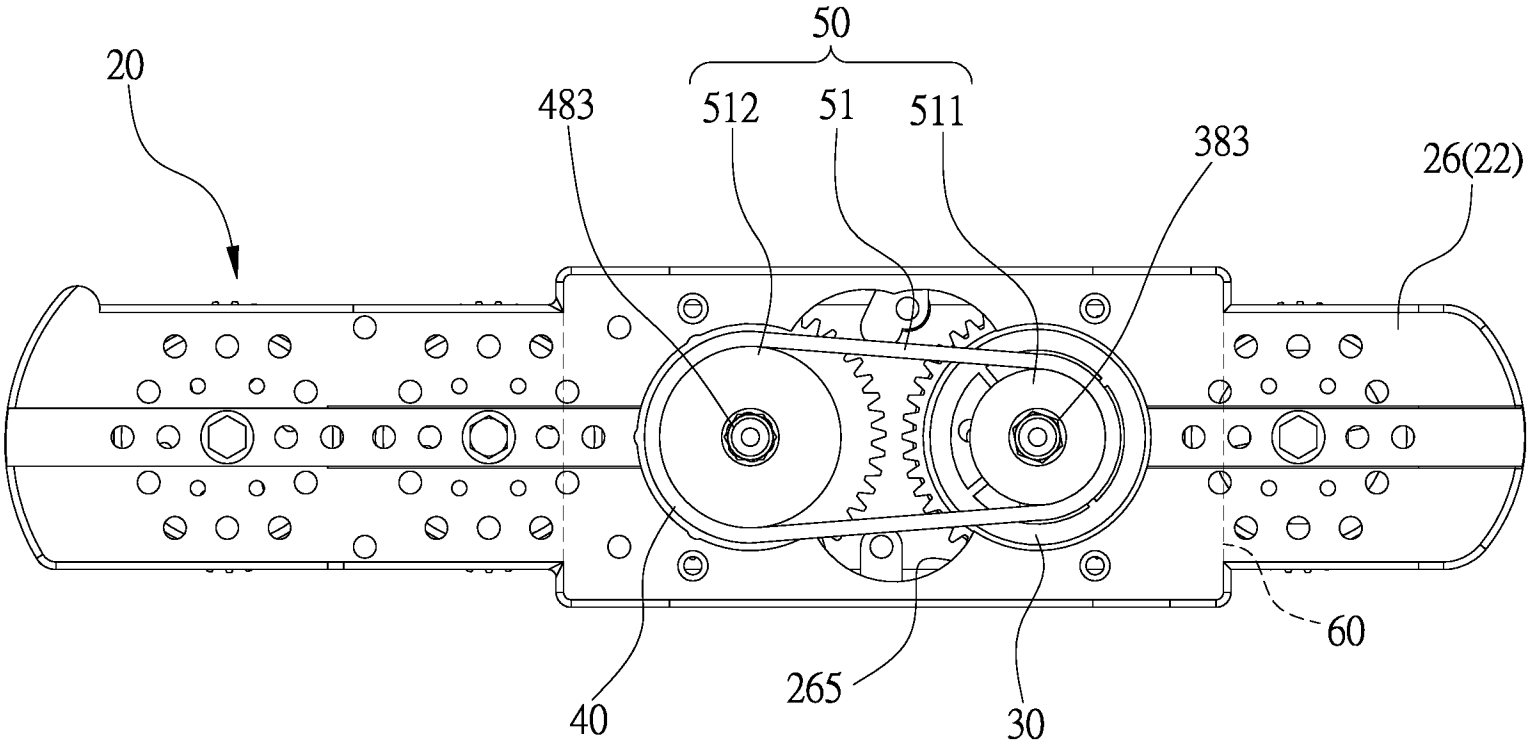
FIG. 13 is a front view of a transmission according to the fifth embodiment of the present invention.

Referring to FIG. 13, there is shown a transmission 20 according to a fifth embodiment of the present invention. The fifth embodiment is identical to the fourth embodiment except for that a belt 51 is used instead of the belt 58 and that two pulleys 511 and 512 are used instead of the pulleys 581 and 582. The belt 51 does not include any teeth, and each of the pulleys 511 and 512 does not either. A diameter of the pulley 512 is preferably smaller than a diameter or the pulley 511.

Figure 14:
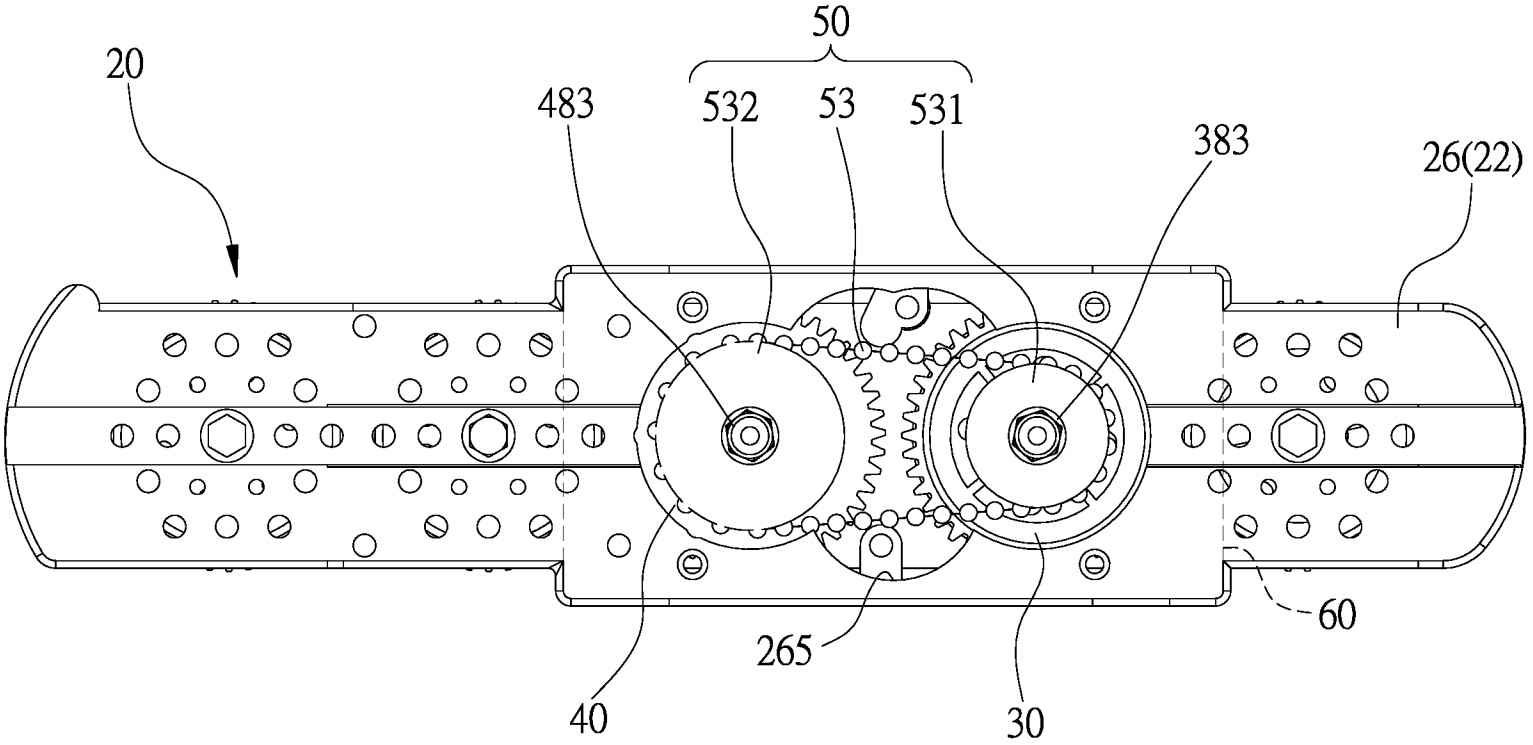
FIG. 14 is a front view of a transmission according to the sixth embodiment of the present invention.

Referring to FIG. 14, there is shown a transmission 20 according to a sixth embodiment of the present invention. The sixth embodiment is identical to the fourth or fifth embodiment except for several features. Firstly, a bead chain 53 is used instead of the belt 51 or 58. Secondly, a wheel 531 is used instead of the pulley 581 or 511. Thirdly, a wheel 532 is used instead of the pulley 582 or 512. The bead chain 53 includes beads (not numbered). Each of the wheels 531 and 532 includes recesses (not numbered) for receiving the beads. Thus, the wheel 532 rotates the wheel 531 via the bead chain 53, i.e., the wheel set 50 transfers a torque to the string reel 30 from the spring reel 40. A diameter of the wheel 532 is preferably smaller than a diameter of the wheel 531.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A Venetian blind comprising:

a frame;

two string reels inserted in and supported by the frame, wherein each of the string reels is formed with a respective gear, wherein the gears of the string reels are in mesh with each other so that the string reels are rotatable in different directions;

two spring reels inserted in and supported by the frame, wherein each of the spring reels is formed with a respective gear, wherein the gears of the spring reels are in mesh with each other so that the spring reels are rotatable in different directions;

a leaf spring comprising two sections respectively wound on the spring reels so that one of the sections of the leaf spring gets longer and a remaining one of the sections of the leaf spring gets shorter when the spring reels are rotated; and a reducer located out of the frame so that the reducer is replaceable with another reducer, wherein the reducer comprises a leading wheel connected to one of the spring reels and a following wheel connected to one of the string reels, wherein the leading wheel is operatively connected to the following wheel, wherein a diameter of the leading wheel is smaller than a diameter of the following wheel so that the string reels rotate slower than the spring reels, and wherein none of the spring reels in engaged with any of the string reels without the reducer.

2. The Venetian blind according to claim 1, wherein the reducer comprises an intermediate gear, and wherein each of the leading and following wheels is a gear engaged with the intermediate gear of the reducer.

3. The Venetian blind according to claim 1, wherein each of the leading and following wheels is a pulley, and the reducer comprises a belt wound on the leading and following pulleys.

4. The Venetian blind according to claim 3, wherein each of the pulleys comprises teeth formed thereon, and the belt comprises teeth engaged with the teeth of the pulleys.

5. The Venetian blind according to claim 1, wherein each of the leading and following wheels includes recesses, and the reducer comprises a bead chain wound on the wheels and formed with beads inserted in the recesses of the leading and following wheels.

6. The Venetian blind according to claim 1, wherein the frame comprises two plates connected to each other, wherein the gears of the string reels are located in a vicinity of one of the plates, and wherein the gears of the spring reels are located in a vicinity of the remaining one of the plates.

7. The Venetian blind according to claim 6, comprising a cover attached to a selected one of the plates, wherein the selected plate comprises an opening covered by the cover, and the reducer is located in the opening and between the frame and the cover.

* * * * *